United States Patent [19]

Nelson

[11] 4,316,349

[45] Feb. 23, 1982

[54] PORTABLE ABRASIVE BELT FINISHING MACHINE

[76] Inventor: Harold E. Nelson, 2126 Kentucky Ave., Fort Wayne, Ind. 46805

[21] Appl. No.: 176,493

[22] Filed: Aug. 8, 1980

Related U.S. Application Data

[63] Continuation of Ser. No. 8,430, Feb. 1, 1979, abandoned.

[51] Int. Cl.[3] ..... B24B 21/00

[52] U.S. Cl. ..... 51/135 R; 51/148; 51/170 EB

[58] Field of Search ..... 51/135 R, 135 BT, 136, 51/137, 138, 141, 142, 147, 148, 170 EB, 273, 268

[56] References Cited

U.S. PATENT DOCUMENTS

| | | | |
|---|---|---|---|
| 561,557 | 6/1896 | Bein | 51/135 R |
| 2,470,615 | 5/1949 | Grover | 51/148 X |
| 2,791,070 | 5/1957 | Schaller | 51/138 |
| 2,992,629 | 7/1961 | Belopavlovich | 51/135 R X |
| 3,110,989 | 11/1963 | Dawson et al. | 51/273 X |
| 3,429,077 | 2/1969 | Grover | 51/148 |
| 3,488,889 | 1/1970 | McCay | 51/135 R |
| 3,538,650 | 11/1970 | Pollak | 51/148 |
| 3,605,343 | 9/1971 | Knecht | 51/135 R X |
| 3,713,255 | 1/1973 | Welsch | 51/170 EB |
| 4,061,126 | 12/1977 | Schlangen | 51/135 R X |
| 4,115,957 | 9/1978 | Porth et al. | 51/170 EB |

*Primary Examiner*—Stephen G. Kunin
*Assistant Examiner*—Robert P. Olszewski
*Attorney, Agent, or Firm*—Thomas R. Vigil

[57] ABSTRACT

The machine includes a base supportable on a horizontal surface and a framework mounted to the base and supporting thereon three rollers in fixed positions with the axes of the rollers extending parallel to each other and the projection thereof forming a right angle triangle in a plane normal to and traversing the axes. The hypotenuse of the right angle triangle faces downwardly, a first leg of the right angle triangle extends horizontally and a second leg of the right angle triangle extends vertically downwardly from the first leg such that the belt received on the machine has a fixed active upwardly facing horizontal flight extending along the first leg of the right angle triangle and a fixed active vertical flight extending along the second leg of the right angle triangle. A first backup platen is fixed to the framework and positioned beneath the horizontal active flight and a second backup platen is fixed to the framework behind the vertical active flight. A motor is mounted to the machine for rotating the rollers such that the horizontal active flight travels to the vertical flight and the vertical flight travels downwardly from the horizontal flight.

12 Claims, 5 Drawing Figures

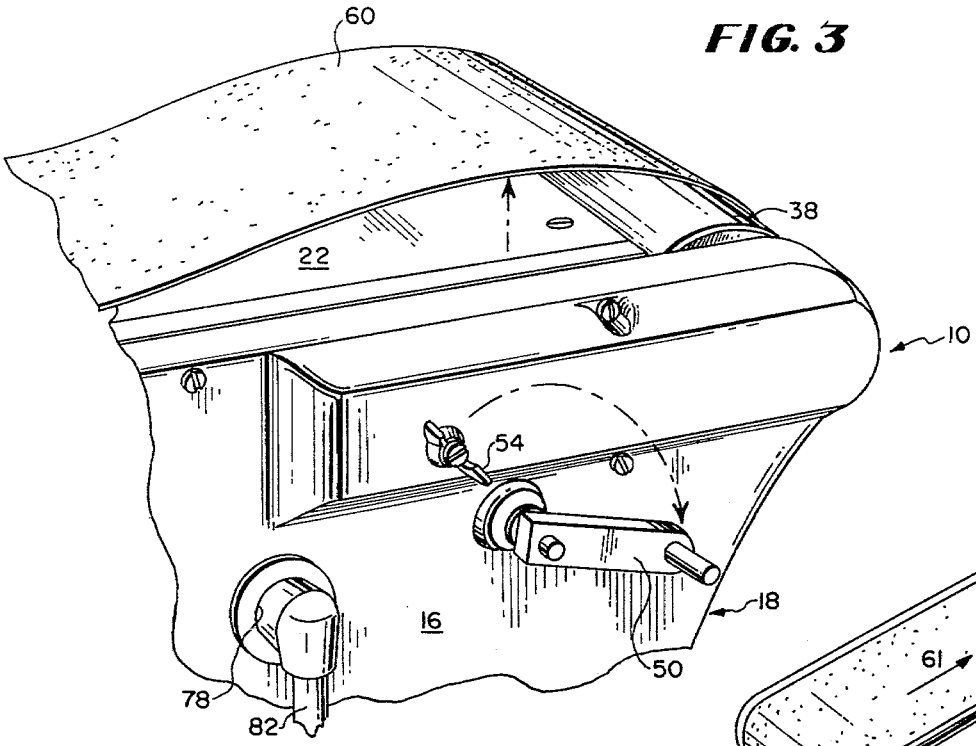
FIG. 3
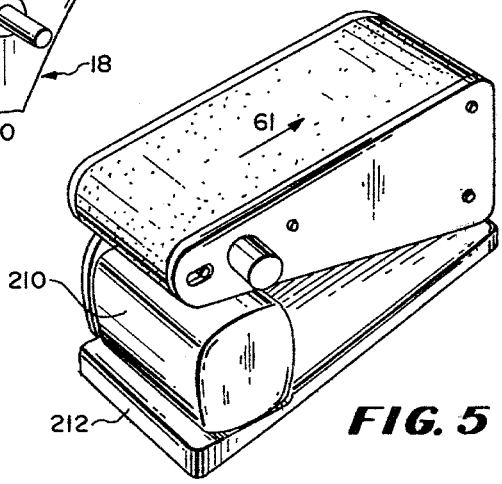
FIG. 5
FIG. 4
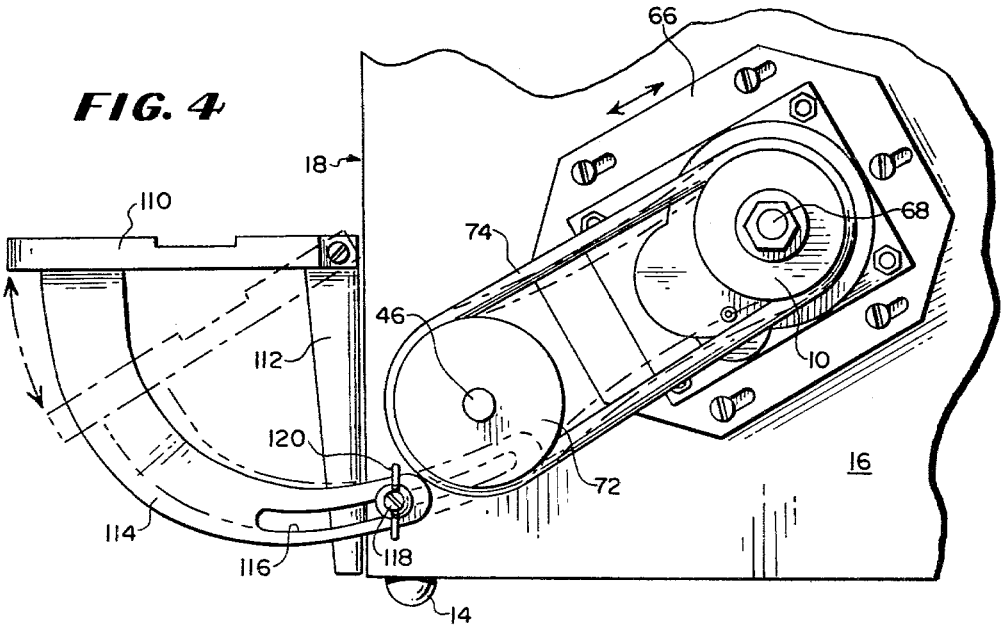

PORTABLE ABRASIVE BELT FINISHING MACHINE

This is a continuation of application Ser. No. 8,430, filed Feb. 1, 1979, now abandoned.

BACKGROUND OF THE INVENTION

1. Field of the Invention

The field of the invention is a portable abrasive belt finishing machine having two supported active flights of a continuous abrasive belt mounted thereon. More specifically, the invention relates to an abrasive belt finishing machine which is portable and which has a fixed supported horizontal active flight and a fixed supported vertical active flight.

2. Description of the Prior Art

Heretofore it has been proposed to mount a continuous abrasive belt on three rollers to provide three flights of the belt with at least one flight being an active flight. Examples of abrasive belt finishing machines or sanders of this type are disclosed in the following U.S. patents.

| PATENTEE | U.S. PAT. NO. |
|---|---|
| Grover | 2,470,615 |
| Bedortha et al | 2,976,652 |
| Guinn | 3,049,841 |
| Dawson et al | 3,110,989 |
| Grover | 3,429,077 |
| Del Vecchio | 3,534,508 |

The Bedortha et al U.S. Pat. No. 2,976,652 discloses a belt sander having a downwardly facing unsupported horizontal active flight.

The Del Vecchio U.S. Pat. No. 3,534,508 discloses a downwardly facing active horizontal flight which is supported, i.e., which has a backup plate behind (above) the active flight.

The Dawson U.S. Pat. No. 3,110,989 discloses an upwardly extending active flight which has a backup plate therebehind.

The Guinn U.S. Pat. No. 3,049,841 discloses a portable handheld sander which has a downwardly facing unsupported horizontal active flight and a vertically extending active flight with a backup plate.

The Grover U.S. Pat. No. 2,470,615 and 3,429,077 disclose a right angle triangular arrangement of the axes of three rollers to provide three flights for a continuous abrasive belt mounted on the rollers with the hypotenuse flight being supported and being an active flight of the belt on the sander. The hypotenuse flight faces upwardly. This sander also provides an unsupported vertical flight on the short leg of the right angle triangle. In this sander, the framework mounting the triangularly arranged rollers can be rotated about the axis of one of the rollers to move the vertical flight to a downwardly facing horizontal flight position and the hypotenuse flight from an inclined angular position with respect to the horizontal through a horizontal position and then to another inclined position.

As will be described in greater detail hereinafter, the portable abrasive belt finishing machine of the present invention differs from the previously proposed abrasive belt finishing machines and sanders of the type disclosed in the patents referred to above by providing a portable machine which has a fixed active horizontal flight of the belt with a backup platen therebeneath and a fixed active vertical flight of the belt with a backup platen therebehind.

SUMMARY OF THE INVENTION

According to the present invention there is provided a compact portable abrasive belt finishing machine comprising a base, a framework fixed to said base and including a first wall panel fixed to and extending upwardly from one side of the base, a second wall panel having a generally right-angle shape, a first generally rectangular backup platen having one side edge fastened to an upper margin of said first wall panel and an opposite side edge fastened to an upper margin of said second wall panel and a second generally rectangular backup platen having one side edge fastened to a side margin of said first wall panel and an opposite edge fastened to a side margin of said second wall panel thereby to form a generally triangular-prism-shaped envelope with a right angle at one upper corner and a hypotenuse extending angularly downwardly from the other upper corner to a lower corner, a first shaft journaled to and between said side wall panels at said right angle corner and mounting a first roller thereon, a second shaft journaled to and between said wall panels at said lower corner and mounting a second roller thereon and a third shaft journaled to and between said wall panels at said other upper corner and mounting a third roller thereon, said rollers being rotatable, said third shaft being releasably fixed in place on said wall panels to facilitate insertion or removal of a continuous abrasive belt onto or off of said generally triangular-prism-shaped envelope over said second wall panel, the path of travel of the belt between said third and first rollers defining a horizontal, supported, active flight, supported by said first backup platen, and the path of travel of the belt between the first and second rollers defining a vertical, supported, active flight, supported by said second backup platen, said horizontal flight being longer than said vertical flight, and a motor mounted to and between said wall panels within said generally triangular-prism-shaped envelope and drivingly coupled to one of said first or second rollers in a manner to cause said horizontal active flight to travel from said third roller to said first roller and to cause the vertical flight to travel downwardly from said first roller to said second roller.

Further according to the present invention, in one preferred embodiment, the machine further includes an elongate stop member mounted on said framework above said first roller in a position to stop a workpiece held on said horizontal active flight, a curved plate fixed to said stop member and extending over and spaced from said first roller therebeneath for covering the curved path of travel of the belt over said first roller, means for pivotally mounting one side of said stop member to said framework, and a latch member fixed to the other side of said elongate stop member and releasably received in a catch member fixed to an opposite side of said framework.

BRIEF DESCRIPTION OF THE DRAWINGS

FIG. 3 is a fragmentary perspective view of the upper right hand corner of the machine as viewed in FIG. 1 showing the movement of a lever arm operating a cam mechanism for positioning the shaft of one of the rollers of the machine in an outward belt-locked position or an inner belt-release position.

FIG. 4 is a fragmentary view of a bottom corner of the machine and shows a pivotally mounted table which is attached to the machine and associated with an active vertical flight of an abrasive belt on the machine.

FIG. 5 is a perspective view of a modified version of the machine wherein a motor for driving the rollers mounting the continuous abrasive belt is mounted on the base of the machine.

DESCRIPTION OF THE PREFERRED EMBODIMENTS

Figure 1:
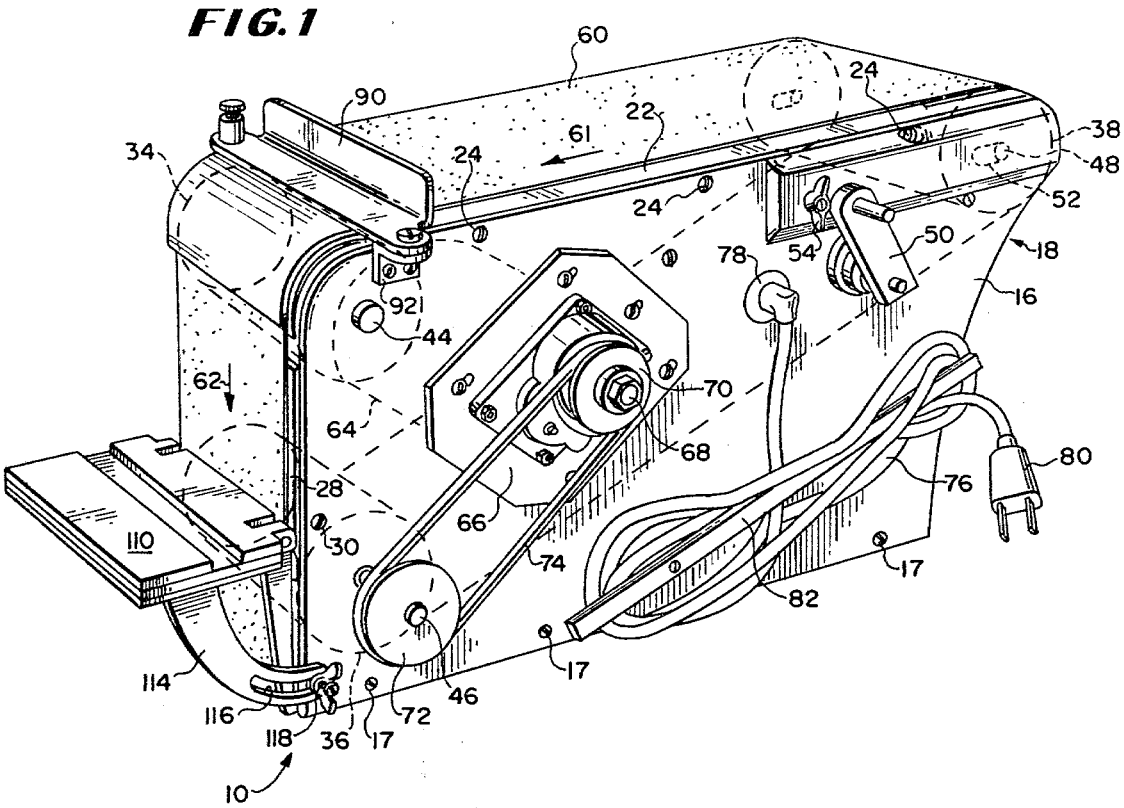
FIG. 1 is a perspective elevational view of the portable abrasive belt finishing machine of the present invention viewing the machine from one side thereof.

Referring now to FIG. 1, there is illustrated therein a portable abrasive belt finishing machine 10 which is often referred to as a belt sander. The machine 10 includes a rectangular base 12 having four rubber supports 14, one in each corner, for supporting the machine 10 in a frictional manner on a horizontal surface against horizontal movement.

Figure 2:
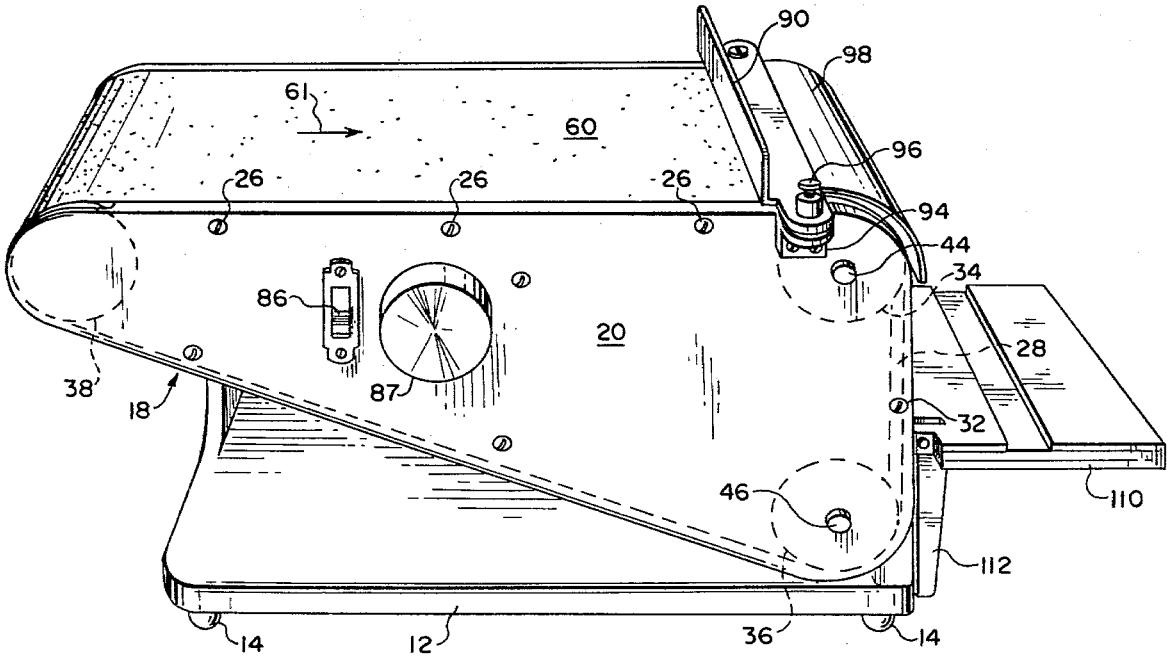
FIG. 2 is a perspective elevational view of the machine shown in FIG. 1 viewing the machine from the other side thereof.

Fixed to one side of the base 12 is a first wall panel 16 which forms part of a framework generally identified by the reference numeral 18. The framework 18 also includes a right angle triangular shaped panel 20 (FIG. 2). A first, horizontally disposed, generally rectangular platen 22 is fastened along one elongate side edge thereof by fasteners 24 to the upper inside margin of the first wall panel 16 (FIG. 1) and on the other side thereof by fasteners 26 to the upper inside margin of the second wall panel 20. A second, vertically disposed, generally rectangular platen 28 is secured by one fastener 30 to a vertical inside margin of the first wall panel 16 (FIG. 1) and by another fastener 32 to a vertical inside margin of the second wall panel 20.

Mounted to the framework 18 between the first and second panels 16 and 20 are three rollers 34, 36, and 38. The first roller 34 is rotatably mounted on a shaft 44 located adjacent an upper right angle corner of the framework 18. The second roller 36 is rotatably mounted on a shaft 46 situated vertically beneath the first roller 34 between the wall panels 16 and 20. The third roller 38 is rotatably mounted on a third shaft 48 at the other upper corner of the framework 18 and horizontally spaced from the first roller 36. This corner is at the junction of the hypotenuse leg and the horizontal elongate leg of the right angle triangularly shaped second panel 20 as shown in FIG. 2.

The third shaft 48 is releasably fixed in place on the framework 18 by means of a suitable cam mechanism which is hidden from view in FIG. 1 and which is operated by a lever arm 50. The lever arm is operable to move the shaft 48 to an outer fixed position within a slot 52 and to hold the shaft 48 in that outer fixed position as shown in FIG. 1. Then, as shown in FIG. 3, the lever arm 50 can be rotated clockwise to release the cam mechanism so that the shaft 48 can move horizontally of the machine 10 within the slot 52. Also a wing nut adjustment 54 coupled to a conventional tracking mechanism for tilting the axis of the roller 48 is provided.

When the shaft 48 and roller 38 mounted thereon are in the released inner position, a continuous abrasive belt 60 can be easily slipped over the second wall panel 20 and onto the three rollers 34, 36 and 38.

It will be apparent from FIGS. 1 and 2 that a projection of the roller shafts 44, 46 and 48 in a plane traversing and normal to the roller shafts 44, 46 and 48 will form a right angle triangle such that the path of travel of the belt 60 from the third roller 38 to the first roller 34 defines a fixed, horizontally extending active flight 61 of the abrasive belt 60 and is supported by the first platen 22. Then the path of travel of the belt 60 from the first roller 34 downwardly to the second roller 36 defines a second fixed active flight 62 of the belt 60 and is supported by the second platen 28. The direction of the flights 61 and 62 are defined by arrows in FIGS. 1 and/or 2.

Fixed to and between the first and second wall panels 16 and 20 in the triangular space defined between the shafts 44, 46 and 48 is an electric motor 64. The motor 64 is mounted by means of a mounting plate 66 to the wall panel 16 as shown in FIG. 1.

Extending outwardly from the mounting plate 66 is a drive shaft 68 of the motor 64 on which is mounted a drive pulley 70. Also, the second shaft 46 extends outwardly from the first wall panel 16 and has a driven pulley 72 fixed thereon. A continuous belt 74 is trained around and drivingly couples the pulleys 70 and 72 for providing a mechanical drive for a belt 60 mounted on the rollers 34, 36 and 38. It will be understood, of course, that the rollers 34 and 38 are freely rotating rollers while roller 36 is driven by the motor 64.

An electric cord 76 is received through a socket 78 in the wall panel 16 for connection to the motor 64 and has a male plug 80 at the outer end thereof for connection to a source of electric current. Also, a cleat 82 is mounted to the panel 16 and the electric cord 76 is coiled on the cleat 82.

A switch 86 is mounted on the second wall panel 20 for easy manipulation to activate or deactivate the electric motor 64. Also, a speed control knob 87 coupled to a conventional speed control circuit for the motor 64 is mounted on the panel 20 adjacent the switch 86.

It will be understood that the shaft 68 of the motor 64 rotates counterclockwise to drive the shaft 46 for the second roller 36 in a counterclockwise direction to pull the continuous abrasive belt 60 downwardly from the first roller 34 to the second roller to define the vertical active flight 61 and then upwardly along the hypotenuse of the triangular configuration of the belt 60 on the rollers 34, 36 and 38 to the third roller 38. Then, from the roller 38, the belt 60 is pulled toward the first roller to define the horizontal active flight 61 of the belt 60.

To facilitate sanding of a workpiece on the fixed horizontal active flight 61, a first elongate stop member 90 is positioned above the first roller 34 against which stop member 90, the workpiece can be held. One side of the elongate step member 90 is pivotally mounted to a bracket 92 which is fixed to the wall panel 16 at a position adjacent the position of the first roller 34. A catch member 94 is mounted on the other side of the framework 18 to the wall panel 20 and is adapted to receive therein a spring biased pin 96 mounted at the other end of the stop member 90. The pin 96 defines a latch member which is snap fittingly received in the catch member 94 to hold the stop member 90 in place across the horizontal active flight 61 above the first roller 34. Also, as a protective cover to prevent abrasions to the hand of an operator using the machine 10 and to channel sawdust removed from a workpiece downwardly instead of horizontally outwardly, a curved plate 98 is fixed to one side of the stop member 90 and extends over the path of travel of the abrasive belt 60 on and over the roller 34.

In use, an operator can place a workpiece against the stop member 90 while sanding the underside of the workpiece received on the horizontal active flight 61.

Also, to facilitate vertical sanding of a workpiece, a table 110 is pivotally mounted to the upper end of a bracket 112 fixed to the base 12 adjacent to and spaced from the second platen 28. An arcuate support arm 114 is fixed to the underside of the table 110 and has an arcuate slot 116 therein within which a fastener 118 is received. The fastener 118 is threadingly received in the wall panel 16. The position of the support arm 114 and thereby the position of the table 110, can be adjusted as shown in FIG. 4 to adjust the angular position of the table 110 by unfastening and then again fastening a wing nut 120 on the fastener 118.

It will be apparent from the foregoing description that the machine 10 of the present invention has a number of advantages some of which have been described above and others of which are inherent in the invention. In particular, the machine 10 provides two fixed active flights 61 and 62 of a continuous abrasive belt 60. One of these flights, flight 61, is a horizontal flight and the other flight, flight 62, is a vertical flight. Also both flights 61 and 62 are supported by respective ones of the supporting platens 22 and 28.

Also from the foregoing description it will be apparent that obvious modifications and variations can be made to the machine 10 of the present invention without departing from the teachings of the invention. For example, instead of mounting the motor 64 between the wall panels 16 and 20, a motor, such as motor 210 in FIG. 5, can be mounted on a base 212 of a modified machine shown in FIG. 5 beneath a junction of the hypotenuse flight of the continuous abrasive belt 60 and the horizontal flight 61 of the belt 60. Accordingly, the scope of the invention is only to be limited as necessitated by the accompanying claims.

I claim:

1. A compact portable abrasive belt finishing machine comprising a base, a framework fixed to said base and including a first wall panel fixed to and extending upwardly from one side of said base, a second wall panel having a generally right-angle shape, a first generally rectangular backup platen having one side edge fastened to an upper margin of said first wall panel and an opposite side edge fastened to an upper margin of said second wall panel and a second generally rectangular backup platen having one side edge fastened to a side margin of said first wall panel and an opposite edge fastened to a side margin of said second wall panel thereby to form a generally triangular-prism-shaped envelope with a right angle at one upper corner and a hypotenuse extending angularly downwardly from the other upper corner to a lower corner, a first shaft journaled to and between said side wall panels at said right angle corner and mounting a first roller thereon, a second shaft journaled to and between said wall panels at said lower corner and mounting a second roller thereon and a third shaft journaled to and between said wall panels at said other upper corner and mounting a third roller thereon, said rollers being rotatable, said third shaft being releasably fixed in place on said wall panels to facilitate insertion or removal of a continuous abrasive belt onto or off of said generally triangular-prism-shaped envelope over said second wall panel, the path of travel of the belt between said third and first rollers defining a horizontal, supported, active flight, supported by said first backup platen, and the path of travel of the belt between the first and second rollers defining a vertical, supported, active flight, supported by said second backup platen, said horizontal flight being longer than said vertical flight, and a motor mounted to and between said wall panels within said generally triangular-prism-shaped envelope and drivingly coupled to one of said first or second rollers in a manner to cause said horizontal active flight to travel from said third roller to said first roller and to cause said vertical flight to travel downwardly from said first roller to said second roller.

2. The machine according to claim 1 including an elongate stop member mounted on said framework above said first roller in a position to stop a workpiece held on said horizontal active flight, a curved plate fixed to said stop member and extending over and spaced from said first roller therebeneath for covering the curved path of travel of the belt over said first roller, means for pivotally mounting one side of said stop member to said framework, and a latch member fixed to the other side of said elongate stop member and releasably received in a catch member fixed to an opposite side of said framework.

3. The machine according to claim 1 further comprising means for controlling the speed of said motor including a speed control knob mounted on said framework.

4. The machine according to claim 1 wherein said base has a plurality of friction members mounted on the bottom thereof for frictionally engaging a supporting surface for holding the machine in place and against horizontal sliding movement.

5. The machine according to claim 1 including a socket mounted in said first wall panel and an electrical cord having a male plug at the outer end thereof and being connected through said socket to said motor and said machine having an electrical switch mounted thereon for activating said motor.

6. The machine according to claim 5 including a cleat which is mounted on said first wall panel and on which said cord can be coiled.

7. The machine according to claim 1 including a cam mechanism mounted to said framework in position to engage and lock said third shaft of said third roller in a first outer position where pressure is placed on a continuous abrasive belt mounted on said rollers to hold the belt taut on said rollers and a second inner position where said third shaft of said third roller is allowed to move inwardly from said first outer position to facilitate insertion of a continuous abrasive belt on or removal of a continuous abrasive belt from said machine, and a lever arm for moving said cam between said first and second positions.

8. The machine according to claim 1 wherein said motor has a shaft extending from one side of said machine, a drive pulley is mounted on said shaft, a driven pulley is mounted on said second shaft for said second roller and a belt drivingly couples said pulleys.

9. The machine according to claim 1 including an elongate stop member mounted on said framework above one of said rollers in a position to stop a work piece held on the horizontal flight.

10. The machine according to claim 9 wherein a curved plate is fixed to said stop member and extends over and is spaced from said roller therebeneath for covering the curved path of travel of the belt over that roller.

11. The machine according to claim 9 wherein one side of said elongate stop member is pivotally mounted to one side of said framework and a latch member is fixed to the other side of said elongate stop member and releasably received in a catch member fixed to an opposite side of said framework.

12. The machine according to claim 1 including a bracket secured to said base and extending upwardly therefrom and being spaced from and adjacent to said second platen, a table member pivotally mounted to the upper end of said bracket and adjustable support means fixed at one end to the underside of said table member and adjustably mounted along an arcuate path to said framework such that said table member is adapted to be pivoted from a horizontal position where it can hold a work piece which is being urged against the vertical flight of the belt to a downwardly extending inclined position.

* * * * *